US005994884A

United States Patent [19]

Paterno

[11] Patent Number: 5,994,884

[45] Date of Patent: Nov. 30, 1999

[54] BOOSTER CIRCUIT FOR FOLDBACK CURRENT LIMITED POWER SUPPLIES

[75] Inventor: Robert M. Paterno, Orange, Va.

[73] Assignee: The United States of America as represented by the Secretary of the Navy, Washington, D.C.

[21] Appl. No.: 09/140,738

[22] Filed: Aug. 27, 1998

[51] Int. Cl.[6] ..... G05F 1/59

[52] U.S. Cl. ..... 323/268; 323/901; 363/49

[58] Field of Search ..... 323/268, 269, 323/272, 273, 274, 276, 277, 282, 284, 285, 901; 363/49

[56] References Cited

U.S. PATENT DOCUMENTS

| | | | |
|---|---|---|---|
| 3,345,554 | 10/1967 | Lupoli | 323/4 |
| 3,723,774 | 3/1973 | Rogers | 307/296 |
| 3,753,078 | 8/1973 | Hedel | 361/56 |
| 3,753,079 | 8/1973 | Trilling | 323/4 |
| 3,771,021 | 11/1973 | Bierly | 323/277 |
| 3,801,894 | 4/1974 | Spiegel | 323/269 |
| 4,017,789 | 4/1977 | Morris | 361/18 |
| 4,180,768 | 12/1979 | Ferraro | 323/278 |
| 4,326,245 | 4/1982 | Saleh | 323/275 |
| 4,513,241 | 4/1985 | Bowman | 323/285 |
| 4,587,476 | 5/1986 | Cushman | 323/276 |
| 4,618,813 | 10/1986 | Vesce et al. | 323/278 |
| 4,658,201 | 4/1987 | Notohamiprodjo | 323/224 |
| 4,660,122 | 4/1987 | Evans | 361/90 |
| 4,791,554 | 12/1988 | Gautherin et al. | 363/49 |
| 5,578,916 | 11/1996 | Muterspaugh | 323/267 |
| 5,666,044 | 9/1997 | Tuozzolo | 323/277 |
| 5,804,955 | 9/1998 | Tuozzolo et al. | 323/277 |

*Primary Examiner*—Jeffrey Sterrett
*Attorney, Agent, or Firm*—James B. Bechtel, Esq.; John P. McMahon, Esq.

[57] ABSTRACT

A booster circuit is provided that inhibits the operation of a foldback current limited power supply during its turn-on phase so that a load may be power to its full output voltage and at the same time retain foldback current limiting during normal operation so that the benefits of short circuit protection are retained.

2 Claims, 3 Drawing Sheets

BOOSTER CIRCUIT FOR FOLDBACK CURRENT LIMITED POWER SUPPLIES

BACKGROUND OF THE INVENTION 1.0 Field of the Invention

The invention relates to power supplies and, more particularly, to a booster circuit for foldback current limited power supply that prevents the foldback current limited power supply from operating during its turn-on phase.

2.0 Description of the Prior Art

Modern power supply engineering design practice requires that provision for short circuit protection be present. Foldback current limiting is a form of control that has the advantage of reducing a short circuit current to considerably less than a predetermined maximum current that can be supplied by the power supply. Power supplies having foldback current limiting and/or current limiting capabilities are well known and some of which are described in the following nine (9) U.S. Patents, all of which are herein incorporated by reference: U.S. Pat. Nos. 3,345,554; 3,723,774; 3,753,079; 4,587,476; 4,658,201; 4,660,122; 4,791,544; 5,578,916 and 5,666,044.

The result of foldback current limiting is that the maximum power dissipation of the power supply components, which occurs during short circuit conditions, is reduced. The reduced maximum power dissipation allows for smaller power transistors and heat sinks which translates into reduced power supply size and cost. However, the foldback current limiting technique has its disadvantages.

Power supplies incorporating foldback current limiting cannot attain their rated output voltage when presented with a predominantly constant current load and when this load is any reasonable fraction of the full rated output current of the power supply. Constant current loading is prevalent in the design practice as many analog circuits of the operational amplifier type present this load. Therefore, any design that incorporates a large array of operational amplifiers of this type, and where this array is a predominant portion of the total load of the power supply, and where this load makes efficient use of the power supply by being a reasonable fraction of the maximum power rating of the power supply, needs to incorporate special provisions for dealing with a foldback current limiting. These special provisions may be further described with reference to FIG. 1.

FIG. 1 depicts the model operating characteristic of a foldback current limited power supply. FIG. 1 represents a graph of output voltage, $V_O$, versus output current $I_O$; time is not a factor in FIG. 1; it is merely a depiction of the various steady state operating conditions of the foldback current limited power supply. During normal operation, the power supply operates along the portion of the characteristic between points A and B. This is to say that the foldback current limited power supply will regulate the output voltage at a constant predetermined value of $V_O$ for any load current ranging from zero to a maximum rated value denoted as $I_{MAX}$ in FIG. 1.

If the load develops a fault that tends to draw current in excess of $I_{MAX}$, the foldback current limited power supply will sense that its output is at point B and will reduce the output current in a manner illustrated by segment B-C of the characteristic of FIG. 1. The foldback current limited power supply will attain a steady state on characteristic B-C at a point determined by the V versus I characteristic of the fault load. A pure short circuit, i.e., a fault which develops zero voltage drop at any load current will cause the supply to reach and maintain operation at point C also indicated by short-circuit current $I_{SC}$. In addition to characterizing the foldback current limited power supply operation during fault conditions, the model curve of FIG. 1 is used to predict the foldback current limited power supply operation during its turn-on phase. The load conditions may be further described with reference to FIG. 2.

FIG. 2 illustrates the characteristics of FIG. 1, but in addition thereto, shows the model operating characteristic with two types of load lines drawn in dashed lines and labeled I and II. In FIG. 2, unlike FIG. 1, time is a factor for the dashed trajectories, that is Type I and II loads, in that it is understood that the load will change in the direction of the arrowheads of the X and Y axes as time proceeds and the voltage across the load increases.

The type I load is characteristics of a predominantly resistive load and lies within the area defined by the operating characteristic O-A-B-C. Type I is the type of load for which the foldback current limited power supply is designed and will not cause turn-on problems as it traverses segment O-F which, as seen in FIG. 2, does not cross the current limit segment C-B. The Type II load is typical of a load which is predominantly constant current. During turn-on, the type II load will attempt to traverse the segment from O to D to E. The power supply foldback limiting will catch the load at point D and maintain the output at the output voltage denoted $V_F$ in FIG. 2. The foldback current limited power supply is now said to be hung at $V_F$ and will not come up to full output voltage $V_O$ at point E which is well within the operating characteristics of the power supply. This hang-up at $V_F$ is then the crux of the problem. It is desired to create corrective means by which the foldback limit operation of the foldback current limited power supply is temporarily suspended during turn-on so that nonlinear loads, that is, those considered to be Type II loads, that are well within the rated operating characteristic of the supply can be powered to the full output voltage, $V_O$; and at the same time retain the foldback limiting during normal operation so that the benefits of short circuit protection are retained.

OBJECTS OF THE INVENTION

It is a primary object of the present invention to provide means by which the foldback limit operation of a foldback current limited power supply is temporarily suspended during turn-on so that nonlinear loads that are well within the rated operating characteristic of the supply can be powered to a full output voltage, $V_O$; and at the same time retain foldback limiting during normal operation so that the benefits of short circuit protection are retained.

It is another object of the present invention to provide means that are designed to be compatible with any linear foldback current limited design in that it will not interfere with normal operation and it will maintain full protection of both the load and the power supply components during fault conditions.

Another object of the present invention is to provide means that serve as an ancillary circuit to an existing power supply so as to be particularly advantageous in that this ancillary circuit provides the benefits of the present invention and allows the use of readily available off-the-shelf power supplies with the attendant benefits of reliability, pre-tested components, verified regulator performance, verified environmental ruggedness and low cost.

Further, it is an object to provide a circuit that performs the benefits of the present invention and is comprised of low cost and readily available components, components that are self-protecting, components that draw a small amount of power from the power supply, and with all of the components comprising a relatively small component count which results in a relatively small sized finished circuit.

In addition, it is an object of the present invention to provide a circuit that can be incorporated into a custom power supply design.

SUMMARY OF THE INVENTION

The invention is directed to a booster circuit that inhibits the operation of a foldback current limited power supply during its turn-on phase.

The foldback current limited power supply has a turn-on phase and provides a maximum current ($I_{MAX}$). The foldback current limited power supply supplies an unregulated voltage at a first terminal and a first regulated output voltage across second and third terminals thereof, with the second terminal being connected to a circuit ground and to a first end of a load. The third terminal makes available current, $I_{PS}$, that is deliverable to the second end of the load. The foldback current limited power supply supplies a predetermined voltage $V_A$ to the load and further comprises a voltage regulator having at least three terminals $V_I$, $V_O$ and ADJ, with the first terminal $V_I$ having means for being connected to the first terminal of the foldback current limited power supply and for receiving the unregulated voltage. The second terminal $V_O$ provides a second regulated output voltage $V_O$, and the second terminal $V_O$ and third terminal ADJ has a voltage $V_R$ therebetween. The foldback current limited power supply further comprises a circuit inhibiting the operation of the foldback current limited power supply comprising a first resistor $R_1$ with a predetermined value and having first and second ends with the first end connected to the second terminal $V_O$ of the voltage regulator. The circuit further comprises a diode $D_1$ as well as second and third resistors. The diode $D_1$, has a known voltage drop $V_D$ thereacross, has its anode connected to the second end of the first resistor $R_1$ and its cathode connected to the second end of the load. The second resistor $R_2$ has a predetermined value and has first and second ends with its first end connected to the second end of the first resistor $R_1$ and with its second end connected to the third terminal ADJ of the voltage regulator. The third resistor $R_3$ has a predetermined value and has first and second ends with the first end connected to the second end of the second resistor $R_2$ forming a node $N_1$ therebetween and with the second end connected to said circuit ground and forming a node $N_2$ therebetween. The predetermined values of the first, second, and third resistors are selected so that the diode $D_1$ is forward-biased during the turn-on phase of the foldback current limited power supply and reversed-biased when said foldback current limited power supply supplies a voltage corresponding to about the predetermined voltage $V_A$.

BRIEF DESCRIPTION OF THE DRAWINGS

These and other objects, features and advantages of the present invention, as well as the invention itself, become better understood by reference to the following detailed description when considered in conjunction with the accompanying drawing wherein.

DETAILED DESCRIPTION OF THE PREFERRED EMBODIMENTS

Figure 3:
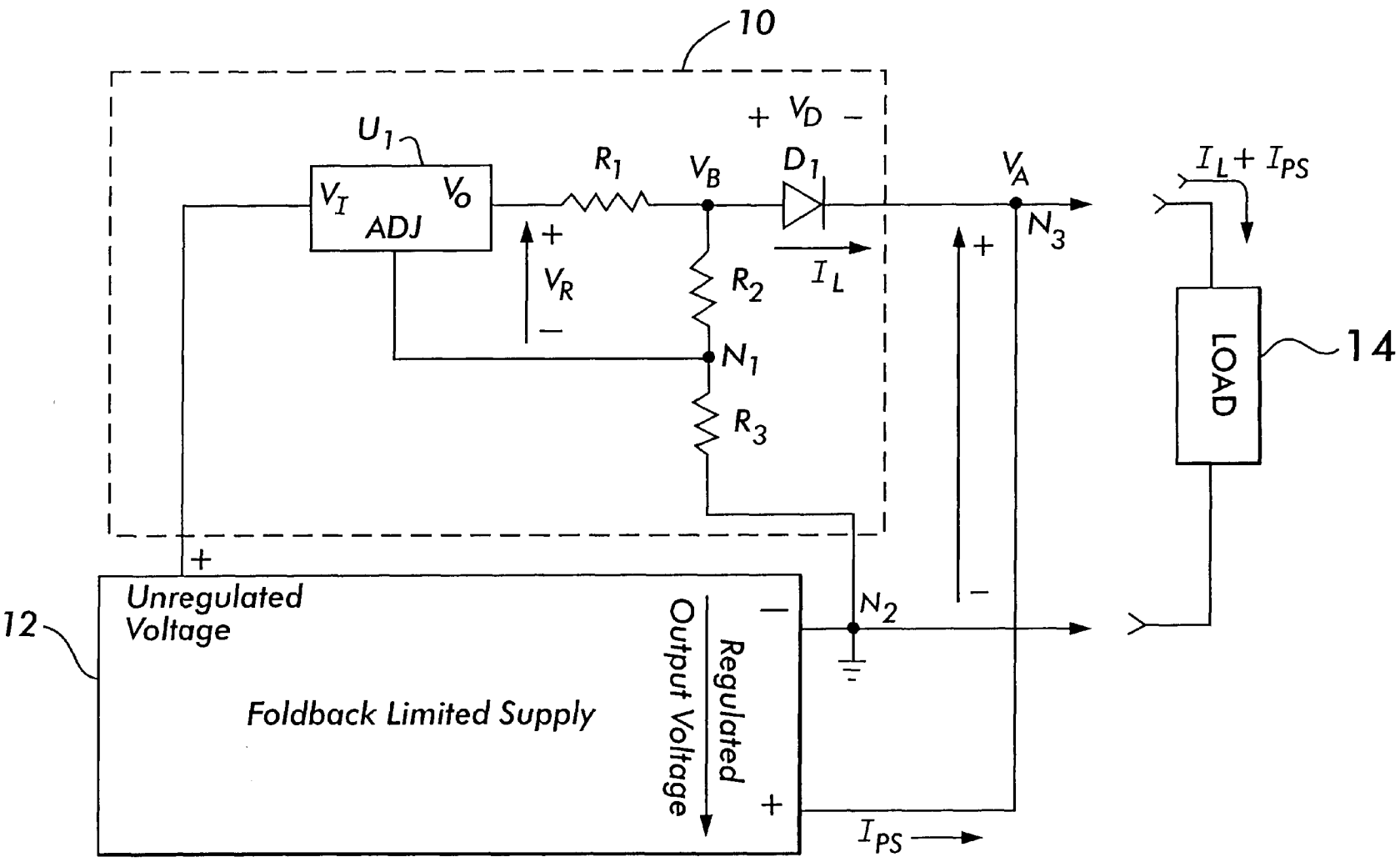
FIG. 3 is a schematic of the present invention.

Referring to the drawings, FIG. 3 illustrates a circuit 10, herein termed "booster circuit," (outlined in phantom) of the present invention, along with a conventional foldback current limited power supply 12 and a load 14. The booster circuit 10 comprises a rectifier diode $D_1$ having a voltage drop $V_D$ thereacross, resistors $R_1$, $R_2$, $R_3$, and a three terminal regulator, U1. The three terminal regulator $U_1$ is a readily available component such as the type LM317 available from National Semiconductor. The three terminal regulator U1 comprises three terminals denoted as $V_1$, $V_O$ and ADJ.

In general, the present invention utilizes a foldback current limited power supply 12 having a turn-on phase and develops a predetermined maximum current $I_{MAX}$. The foldback current limited power supply 12 generates a regulated output voltage and an unregulated voltage (both shown in FIG. 3) with the unregulated voltage being applied as an input voltage to terminal $V_1$ of the three terminal regulator U1. The unregulated voltage is made available at a first terminal and the regulated output voltage is made available across second and third terminals, with the second terminal being connected to circuit ground and to a first end of load 14 and with the third terminal making available current, $I_{PS}$, that is deliverable to the second end of the load 14.

The three terminal regulator U1 delivers current to its $V_O$ terminal as necessary in order to maintain a constant voltage, denoted $V_R$ in FIG. 3, between its terminals $V_O$ and ADJ. The three terminal regulator U1 employs constant current limiting in addition to foldback current limiting based upon an internal junction temperature sensing scheme. This latter characteristic is important to the present invention in that it is a self-protection scheme which eliminates the need for an external heat sink and allows the components thereof to be used without additional short circuit protection circuits. In normal operation, the foldback current limited power supply 12 delivers energy from the node labeled "unregulated voltage" to the output node, that is, the third (+) terminal (regulated output voltage) in the form of current, $I_{PS}$, so as to maintain the output voltage $V_A$ at node $N_3$ at a predetermined value.

Figure 1:
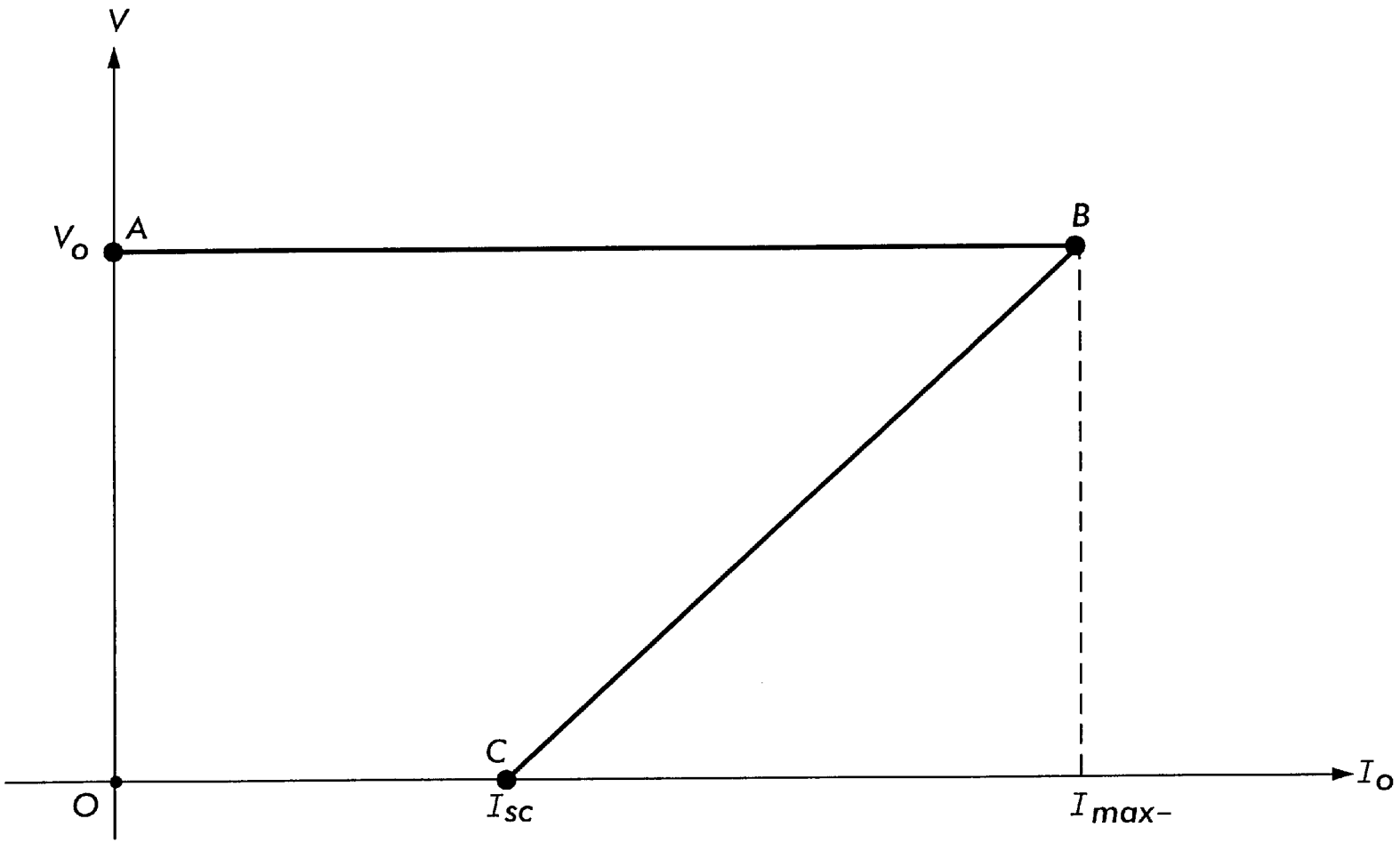
FIG. 1 depicts a model operating characteristic of a foldback current limited power supply.
Figure 2:
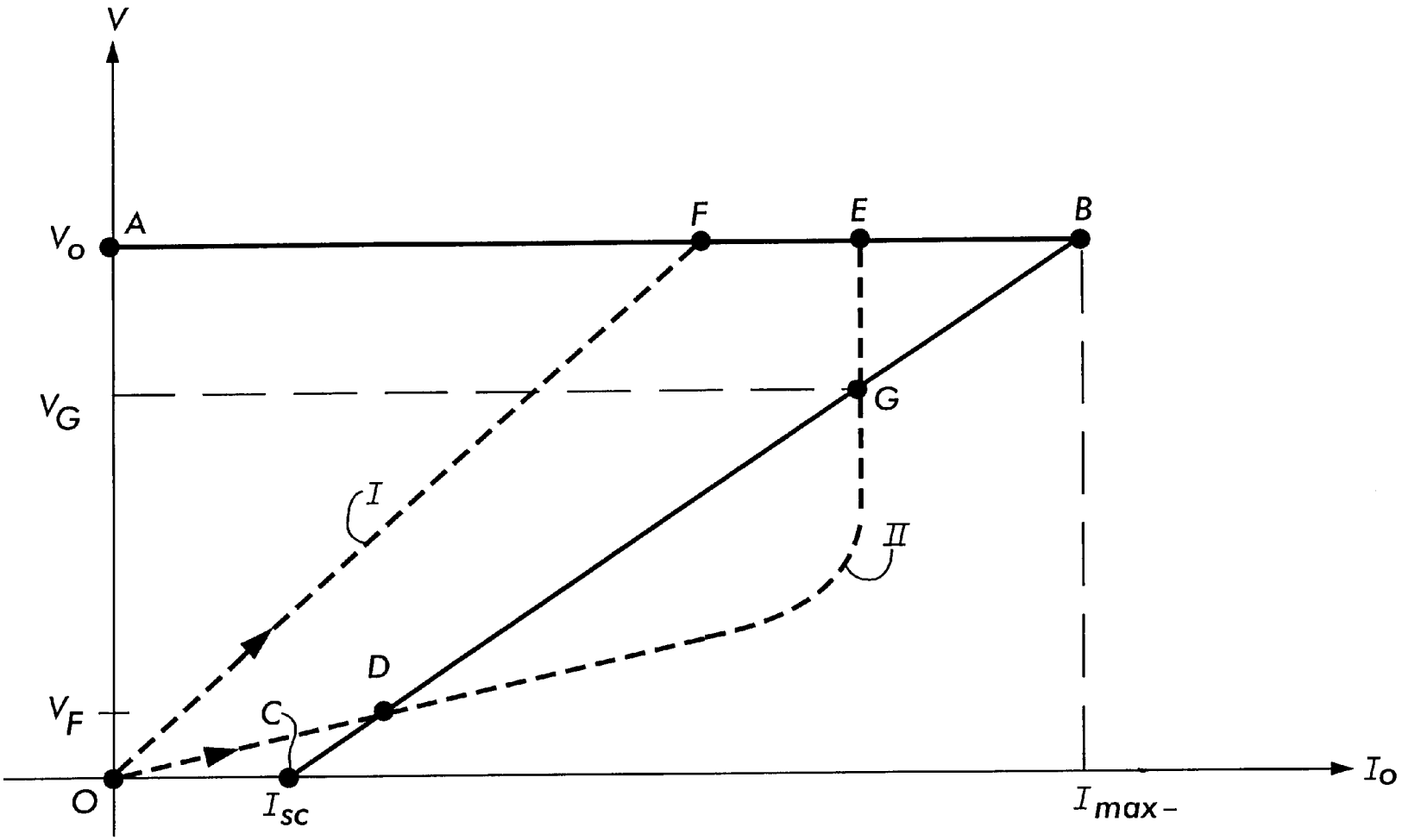
FIG. 2 depicts a model operating characteristic of a foldback current limited power supply servicing Types I and II loads.

The booster circuit 10 operates in parallel with foldback current limited power supply 12 between the unregulated voltage node and the output node. The booster circuit 10 effectively inhibits the operation of the foldback current limited power supply 12 during the turn-on phase of the foldback current limited power supply 12. More particularly, a basic principle of the booster circuit 10 is to supply drive current into the load 14 during turn-on of the foldback current limited power supply 12 so that the output voltage $V_A$, will rise to a value large enough along the C-B segment of the characteristic of FIG. 2 to support the load in a manner to be further described. At this point, that is, when a large enough voltage has been attained, the diode $D_1$ of the booster circuit 10 is reversed-biased or backbiased, and the booster circuit 10 will cease delivering current and it will remain in a quiescent state that does not interfere with the remainder of the foldback current limited power supply 12 operation. Referring to FIG. 2, the backbias voltage of diode $D_1$ required for the Type II load would be any voltage between the values designated $V_G$ and $V_O$; it can be seen that at output voltages of this magnitude (between $V_G$ and $V_O$), the Type II load does not activate the foldback current limiting operation of the foldback current limited power supply 12 as it traverses the G-E segment of FIG. 2, so that the foldback current limited power supply 12 is capable of powering the load to the full rated voltage $V_O$ from point G onward to point E.

The current limiting provided by the present invention takes into account the total current drawn from the unregulated voltage source, that is, foldback current limited power supply 12 by both the booster circuit 10 and the foldback current limited power supply 12 itself. The unregulated voltage source of the foldback current limited power supply 12 is typically developed with a combination of a stepdown transformer, rectifier diodes and filter capacitors; these components are not shown and are assumed to be contained within the conventional foldback current limited power supply 12 of FIG. 3. These components are selected in accordance with a root-mean-square (RMS) current rating (among other factors) which is directly related, in a manner known in the art, to the direct current (D.C.) that the unregulated voltage source of the foldback current limited power supply 12 is required to deliver. Therefore, in accordance with the practice of the present invention, a means must be provided so that the totality of direct current drawn from the unregulated voltage source by both the booster circuit 10 and the foldback current limited power supply 12 itself does not exceed the maximum rated current $I_{MAX}$ of the foldback current limited power supply 12 at any instant in time; this will ensure that all original components operate within their safe operating areas.

The booster circuit 10 accomplishes the limiting of the totality of direct current by limiting the current available from the three terminal regulator U1 in such a way that this limit decreases with increasing output voltage $V_A$. Noting in FIG. 2 that the foldback current limited power supply 12 segment C-B exhibits a current limit that increases with increasing output voltage $V_A$, the combined effect of these limiting characteristics results in a constant current limit. If this constant current limit is held to a value that is less than $I_{MAX}$, the components producing the unregulated voltage, that is, those of the foldback current limited power supply 12, will be operating safely within their design ratings.

The booster circuit 10 comprises the various components of FIG. 3 having values and whose operations may be mathematically described. The component of FIG. 3, in particular, the first ($R_1$), second ($R_2$) and third ($R_3$) resistors have predetermined values which are selected so that the diode $D_1$ is forwarded-biased during the turn-on phase of the foldback current limited power supply 12 and reversed-biased when the foldback current limited power supply 12 supplies a voltage corresponding to about a predetermined voltage $V_A$ desired to be supplied to the load 14.

The mathematical description of the operation of the booster circuit 10 of the present invention makes use of the notations of FIGS. 2 and 3. The booster circuit 10 description is divided into three separate and distinct modes I, II and III of operation. The first mode I consists of circuit operation of booster circuit 10 when $V_A$ is zero volts. This mode I is in effect when the configuration of FIG. 3 is operating into a short circuit or when this configuration, which includes the foldback current limited power supply 12, is at the initial instant of the turn-on phase. The second mode II of operation, entails circuit operation when both $V_A$ and $I_L$, that is, the current supplied by the three terminal regulator U1, are greater than zero; this mode II describes circuit operation during the turn-on boost condition. The third and final mode III of operation, entails the circuit operation when $I_L$ is zero. This mode III is in effect when the FIG. 3 configuration is in steady state with diode $D_1$ backbiased, $V_A$ at rated output voltage, and total load current is derived from $I_{PS}$ (shown in FIG. 3) of the foldback current limited power supply 12. The mathematical equations which describe the three modes III are used to set the component values of $R_1$, $R_2$ and $R_3$ and therefore determine the actual make-up of booster circuit 10.

Mode I operation is centered on the previous description of the three terminal regulator U1 reference voltage, $V_R$. The three terminal regulator, U1, delivers current, $I_L$, through the $V_O$ terminal as necessary to maintain a constant potential of $V_R$ volts between terminals $V_O$ and ADJ. Note that $V_R$ refers to a fixed voltage and not a mathematical variable; in the case of the LM317 serving as U1, this value is fixed at 1.25 volts. Summing voltage drops around the loop formed by terminal $V_O$, resistors $R_1$ and $R_2$, and terminal ADJ, yields the equation $V_R=V_{R1}+V_{R2}$, where $V_{R1}$ is the voltage drop across $R_1$ and $V_{R2}$ is the voltage drop across $R_2$. Since $V_A=0$ during mode I, the voltage $V_B$, shown in FIG. 3, is just $V_D$, that is, the voltage drop across diode $D_1$, so that using the voltage divider principle, $V_{R2}=V_D*R_2/(R_2+R_3)$, with resistors $R_2$ and $R_3$ having a node $N_1$ therebetween and with resistor $R_3$ connected to ground with a node $N_2$ therebetween. The current through $R_2$ is then $V_{R2}/R_2$ or $V_D/(R_2+R_3)$. This enables the computation of $V_{R1}$ in terms of current $I_L$ since the current through $R_1$ is the sum of $I_L$ and the current through $R_2$ or $I_L+V_D/(R_2+R_3)$. Substituting these expressions into the original equation for $V_R(V_{R1}+V_{R2})$ yields $V_R=(I_L+V_D/(R_2+R_3))*R_1+V_D*R_2/(R_2+R_3)$. This equation can be arranged into equation (1):

$$I_L=V_R/R_1-V_D*(R_2+R_1)/(R_1*(R_2+R_3)) \quad (1)$$

This equation (1) defines the short circuit limit of the booster circuit of FIG. 3. The total short circuit current into the load 14 will be the sum of $I_L$ of equation (1) and the short circuit limit, $I_{SC}$ (as defined in FIG. 2), of the foldback current limited power supply 12. This total must not exceed $I_{MAX}$ (see FIG. 2 again) if the components of the unregulated portion of the foldback current limited power supply 12 are to remain in their safe operating areas as discussed hereinbefore. This constraint results in equation (2) which completes the consideration for mode I:

$$V_R/R_1-V_D*(R_2+R_1)/(R_1*(R_2+R_3))+I_{SC}<=I_{MAX} \quad (2)$$

The calculation of Mode II operation uses the same loop discussed with regard to mode I, where $V_R$ is equated to the sum of voltage drops across $R_1$ and $R_2$. The drop across $R_2$ is $V_B*R_2/(R_2+R_3)$ and by the voltage divider principle; the drop across $R_1$ is $R_1*$(total current through $R_1$). The current through $R_1$ is $I_L+V_B/(R_2+R_3)$. Noting that $V_B=V_A+V_D$ yields equation (3):

$$V_R=(V_A+V_D)*R_2/(R_2+R_3)+R_1*(I_L+(V_A+V_D)/(R_2+R_3)) \quad (3)$$

This equation (3) may be rearranged to solve for $I_L$ in Mode II and which completes the consideration for Mode II as:

$$I_L=V_R/R_1-(V_A+V_D)*(R_2+R_1)/(R_1*(R_2+R_3)) \quad (4)$$

The calculation of Mode III starts with equation (4) and is defined by setting $I_L=0$ in equation (4) so as to yield equation (5):

$$V_A=V_R*(R_2+R_3)/(R_2+R_1)-V_D \quad (5)$$

The final performance equation involves computing the total current delivered to the load denoted as $I_L+I_{PS}$ in FIG.

3. Referring to FIG. 2, the segment C-B which represents the worst case current delivered by the foldback current limited power supply 12 is defined by $I=V^*(I_{MAX}-I_{SC})/V_O+I_{SC}$. Substituting $V=V_A$ and $I=I_{PS}$ in this equation and adding to equation (4) yields the total current of equation (6):

$$I_{PS}+I_L=V_A^*(I_{MAX}-I_{SC})/V_O+I_{SC}+V_R/R_1-(V_A+V_D)^*(R_1+R_2)/((R_2+R_3)^*R_1) \quad (6)$$

Equation (6) is further arranged in terms of $V_A$ to yield equation (6.1).

$$I_{PS}+I_L=V_A^*((I_{MAX}-I_{SC})/V_O-(R_2+R_1)/((R_2+R_3)^*R_1))+I_{SC}+(V_R/R_1-V_D^*(R_2+R_1)/((R_2+R_3)^*R_1) \quad (6.1)$$

Note that equation (6.1) is an equation of a straight line. The starting point is: $I_{SC}+V_R/R_1-V_D^*(R_2+R_1)/((R_2+R_3)^*R_1))$ which is recognized as equation (2), the short circuit current equation. The slope is $((I_{MAX}-I_{SC}/V_O-(R_2+R_1)/((R_2+R_3)^*R_1))$ which must be maintained at 0 or a negative value. This completes the set of constraints from which the values of $R_1$, $R_2$, and $R_3$ are determined. These constraints and considerations are summarized below for expression (C.1); (C.2); (C.3), and (C.4):

$$((I_{MAX}-I_{SC})/V_O-(R_2+R_1)/((R_2+R_3)^*R_1))\leqq \text{current must not increase} \quad (C.1)$$

$$I_{SC}+V_R/R_1-V_D^*(R_2+R_1)/((R_2+R_3)^*R_1)\leqq I_{MAX} \quad (C.2)$$

$$V_G\leqq V_R^*(R_2+R_3)/(R_2+R_1)-V_D \text{ power on phase boosts output voltage to second intercept with segment C-B of FIG. 2} \quad (C.3)$$

$$I_{LOAD,MAX}=(V_R^*(R_2+R_3)/(R_2+R_1)-V_D)^*(I_{MAX}-I_{SC})/V_O+I_{SC} \quad (C.4)$$

Note that in constraint (C.2), the diode voltage $V_D$ must be assigned its "on" value whereas in (C.3), the diode voltage $V_D$ Must be assigned its "off" value. The final constraint (C.4) is the equation for the maximum possible nonlinear load that the resulting boosted supply, made available by the operation of booster circuit 10, can power-on without hanging up on segment C-B in a manner as described in the "Background" section. Constraint (C.4) is derived by substituting the value f or $V_A$ computed in equation (5) into the equation of segment C-B. This results in a value of $I_{PS}$ on segment C-B where the current delivered by U1 has tapered to 0; since the total configuration current is never less than this amount, the value of $I_{PS}$ so computed is the maximum constant current load that the boosted configuration can bring up to rated output voltage. This set of constraints set out by the practice of the present invention, will always have a solution for practical power supply values of $I_{MAX}$, $V_O$, $V_G$, and $V_R$.

The booster circuit 10 needs to operate so that in the event of a circuit load fault, the composite network of foldback current limited power supply 12 and the booster circuit 10 at first limits the fault current to a constant value of $I_{SC}+V_R/R_1-V_D^*(R_2+R_1)/((R_2+R_3)^*R_1)$, in a manner as previously described. The individual components of the composite network exhibit the original current limiting characteristics; i.e., the foldback current limited power supply 12 exhibits foldback current limiting and settles somewhere on segment C-B of FIG. 2, and the booster circuit 10 exhibits the inverse current limiting characteristic. After a time determined by the thermal characteristics of the three terminal regulator, U1, U1 may go into thermal foldback current limiting so that the composite network will now exhibit a foldback limiting characteristic eventually converging to the characteristic of the foldback current limited power supply 12 acting alone. Thus, all the benefits of current limiting are retained; the power dissipating components of the foldback current limited power supply 12 are protected as before the addition of the invention, and the load 14 circuit components are protected from excessive power dissipation first by constant current limiting and then by the foldback current limiting operation of power supply 12.

The values of the components of the booster circuit 10 needs to take into account the parameters of a typical foldback current limited power supply 12. A practical foldback current limited power supply 12 has the specifications $I_{MAX}=0.5$, $I_{SC}=0.01$, $V_O=15$, and regulation 5% over temperature. Here it may be demonstrated that the booster circuit 10 invention will easily allow a pure constant current load to use a full 90% of the rated power supply current. The regulation specification of a typical foldback current limited power supply 12 allows the supply output to decrease to 0.95*15=14.25. This (14.25) will be the $V_G$ value of constraint C.3 previously described. Defining $(R_2+R_3)/(R_2+R_1)=R_T$ and plugging into constraint C.3 with $V_D=0.2$ (off, reversed-biased) yields $R_T=11.56$. This value (11.56) is then substituted into constraint C.2, yielding $R_1=2.43$. As a check, $R_T$ and $R_1$ may be plugged into constraint C.1 and the slope of $V_A$ may be solved to be −0.003. This check ensures that the maximum current ($I_{MAX}$) is not exceeded. Finally, $R_2$ and $R_3$ must be solved; given that $R_T=11.56$. Any values of $R_2$ and $R_3$ serve the desired purpose except there is usually another constraint. More particularly, in the case of the LM317 utilized for U1, the manufacturer recommends a bias current of at least 0.01. This leads to $0.01=V_R/(R_1+R_2)$ from which $R_2$ is then fixed. When these values are substituted into constraint C.4 with $V_D=0.7$, the maximum load is computed as 0.46. This represents a 0.46/0.5=90% use of the available foldback current limited power supply 12 current. Equation (5) is used as a double check to compute that $V_D=0.2$ at the minimum output voltage so that the booster circuit 10 is effectively off and not supplying load current at full rated output voltage. The power supply discussed above with $I_{SC}=0.01$ could not start at all into a typical 0.46 A constant current load; actually this non-starting power supply could not start into a 0.12 A constant current load which is ≦20% utilization of the available power supply current. These numbers serve to illustrate the dramatic increase of foldback current limited power supply 12 utilization resulting from the booster circuit 10 of the present invention.

It is understood that the invention is not limited to the specific embodiments herein illustrated and described but may be otherwise without departing in the spirit and scope of the invention.

What I claim is:

1. A foldback limited power supply having a turn-on phase and having a predetermined maximum current, said foldback limiting power supply supplying an unregulated voltage at first terminal and a first regulated output voltage across second and third terminals with the second terminal being connected to a circuit ground and to a first end of a load, said third terminal making available current that is deliverable to the second end of said load; said foldback limited power supply supplying a predetermined voltage to said load and further comprising:

(a) a voltage regulator having at least three terminals, with the first terminal having means for being connected to the first terminal of said foldback limited power supply and receiving said unregulated voltage, the second terminal providing a second regulated output voltage, and the second terminal and third terminal having a voltage therebetween; and (b) a circuit inhibiting the operation of said foldback current limiting power supply during said turn-on phase and comprising:

(i) a first resistor with a predetermined value and having first and second ends with the first end connected to the second terminal of said voltage regulator;

(ii) a diode having a known voltage drop and having its anode connected to the second end of said first resistor and its cathode connected to said second end of said load;

(iii) a second resistor with a predetermined value and having first and second ends with its first end connected to said second end of said first resistor and with its second end connected to the third terminal of said voltage regulator; and (iv) a third resistor with a predetermined value and having first and second ends with the first end connected to said second end of said second resistor forming a first node therebetween and with the second end connected to said circuit ground and forming a second node therebetween;

said predetermined values of said first, second and third resistors being selected so that said diode is forwarded biased during said turn-on phase of said foldback current limiting power supply and reversed-biased when said foldback current limiting power supply supplies a voltage corresponding to about said predetermined voltage.

2. The power supply according to claim 1, wherein said voltage regulator further comprises means for providing over-temperature and short-circuit protections.

* * * * *